United States Patent [19]

Gram

[11] 4,377,936

[45] Mar. 29, 1983

[54] FREEZING OR COOLING PLANT

[75] Inventor: Hans Gram, Vojens, Denmark

[73] Assignee: Brodrene Gram A/S, Vojens, Denmark

[21] Appl. No.: 322,658

[22] Filed: Nov. 18, 1981

[30] Foreign Application Priority Data

Dec. 3, 1980 [DK] Denmark ..... 5169/80

[51] Int. Cl.[3] ..... A23G 9/00

[52] U.S. Cl. ..... 62/346; 165/89

[58] Field of Search ..... 62/345, 346, 353, 500; 165/89, 91, 94

[56] References Cited

U.S. PATENT DOCUMENTS 1,897,613 2/1933 Jensen ..... 62/346

3,092,978 6/1963 Lorentzen ..... 62/346

*Primary Examiner*—Ronald C. Capossela

*Attorney, Agent, or Firm*—Watson, Cole, Grindle & Watson

[57] ABSTRACT

A freezing or cooling plant comprises an apparatus having an evaporator chamber. At the lower end the apparatus is connected with a feed conduit for liquid refrigerant and a suction conduit for suctioning refrigerant vapors. Both conduits communicate with a vessel in such a way that liquid refrigerant from the apparatus may flow to the vessel via both the conduits. By heating the apparatus due to washing of the outer surface of the evaporating chamber of the apparatus, only moderate pressure rises will occur in the apparatus since, after the cooling process is stopped, the apparatus will be emptied of liquid refrigerant and during the remaining washing period will contain solely superheated refrigerant vapors.

2 Claims, 2 Drawing Figures

FREEZING OR COOLING PLANT

BACKGROUND OF THE INVENTION

The present invention relates to a freezing or cooling plant comprising an apparatus having an evaporator chamber which is fed with refrigerant and from which evaporated refrigerant is suctioned by means of conduits which form part of a circuit which also comprises a compressor and a condenser.

Usually, during the operation of freezing or cooling plants of the aforementioned type, the refrigerant is fed to the lower end of the evaporator and the refrigerant vapours are suctioned from the top of the evaporator. However, such cooling or freezing plants are inappropriate in cases where the apparatus provided with the evaporator chamber is to be cleaned, e.g. by being washed with a hot detergent. During such washing operation complicated precautions must be taken in order to avoid high pressures in the evaporator chamber caused by the heating.

SUMMARY OF THE INVENTION

It is the object of the present invention to provide a plant of the type referred to above wherein pressures in the evaporator chamber and accordingly, in the apparatus, are avoided by heating the apparatus. Such is effected according to the invention in that the conduits for feeding refrigerant into and for suctioning evaporated refrigerant from the evaporator, respectively, are connected with the lower end of the apparatus and that the circuit, moreover, comprises a vessel for accommodating liquid refrigerant from the apparatus. With such construction liquid refrigerant which may be positioned in the apparatus at the beginning of the heating of the apparatus will be transferred to the aforementioned vessel at a rather moderate pressure increase in the apparatus. Because the apparatus is closed upwardly, the vapours produced by the heating will press liquid refrigerant, which may be contained in the apparatus, and out of the apparatus such that, in addition to the evaporation of the small amount of refrigerant which is necessary in order to create the pressure which may be necessary to press liquid refrigerant out of the apparatus, no evaporation takes place in the apparatus. On the other hand, by continued heating of the apparatus only superheating of the vapours present in the apparatus will take place and, accordingly, the pressure in the apparatus will rise far less by heating the apparatus than if liquid refrigerant were present in the apparatus. In the latter instance the pressure in the apparatus would follow the vapour pressure curve for saturated vapour of the refrigerant in question, and such saturated vapour pressure rises far more rapidly at increasing temperature than when only superheating takes place.

A particularly simple embodiment of the plant according to the invention is characterized in that the vessel constitutes a liquid/vapour separator which at the top of the separator is connected with the compressor, and which between the top and the bottom is connected with the suction conduit connected to the apparatus and the lower part of which is connected with the feeding conduit for liquid refrigerant, and, moreover, in that a feed pump of the flow type is provided in the feed conduit. Therefore, the liquid/vapour separator, besides serving as a vessel for accommodating liquid refrigerant from the apparatus, will also serve as a liquid/vapour separator and the use of a pump of the flow type allows the liquid refrigerant to flow to the separator under the aforementioned conditions both through the suction conduit connected with the apparatus and through the feed conduit for liquid refrigerant. Such embodiment of the plant becomes extremely simple when the pump comprises an injector because such injector may be driven by the refrigerant and may serve as a circulation pump between the evaporator chamber of the apparatus and the separator because the inlet of the injector for secondary medium may be connected with the separator. Moreover, such injector will simultaneously allow return flow of liquid refrigerant from the apparatus and to the separator when the feeding of the injector with primary medium, viz. liquid refrigerant, is interrupted. However, this does not exclude the provision of other pumps of the flow type which may be used as a circulation pump, although such a pump must be driven by appropriate means such as a motor.

The cleaning of the apparatus as referred to above is of particular importance when the apparatus of the plant is used for freezing liquid mediums such as e.g. water, blood, cream or the like materials. Such products require a periodic cleaning of the apparatus. An embodiment of the plant which is particularly suitable for achieving the object according to the invention is characterized in that the evaporator chamber of the apparatus is defined by a space between the wall of a vertically arranged cylindrical container provided with end bottoms and a cup shaped container arranged within the cylindrical container, that the space communicates with the interior of the cup shaped container via a space between the upper edge of the inner container and the upper end bottom of the cylindrical container, that the suction conduit is connected with the bottom of the cup shaped container, and that the feed conduit is connected with the space between the lower end bottom of the cylindrical container and the bottom of the cup shaped container.

In cases where the cylindrical container is rotatable, such that the scraping off or bursting off of material, which may freeze on the outer surface of the cylindrical container, is easily carried out, the suction conduit may according to the invention be connected with the bottom of the cup shaped container by means of a hollow trunnion and the feed conduit may be connected with the space between the lower end bottom of the cylindrical container and the bottom of the cup shaped container by means of a stuffing box which is arranged coaxially in the hollow trunnion and which is connected with the aforementioned space by means of a transversely extending conduit.

DESCRIPTION OF THE PREFERRED EMBODIMENTS

Figure 1:
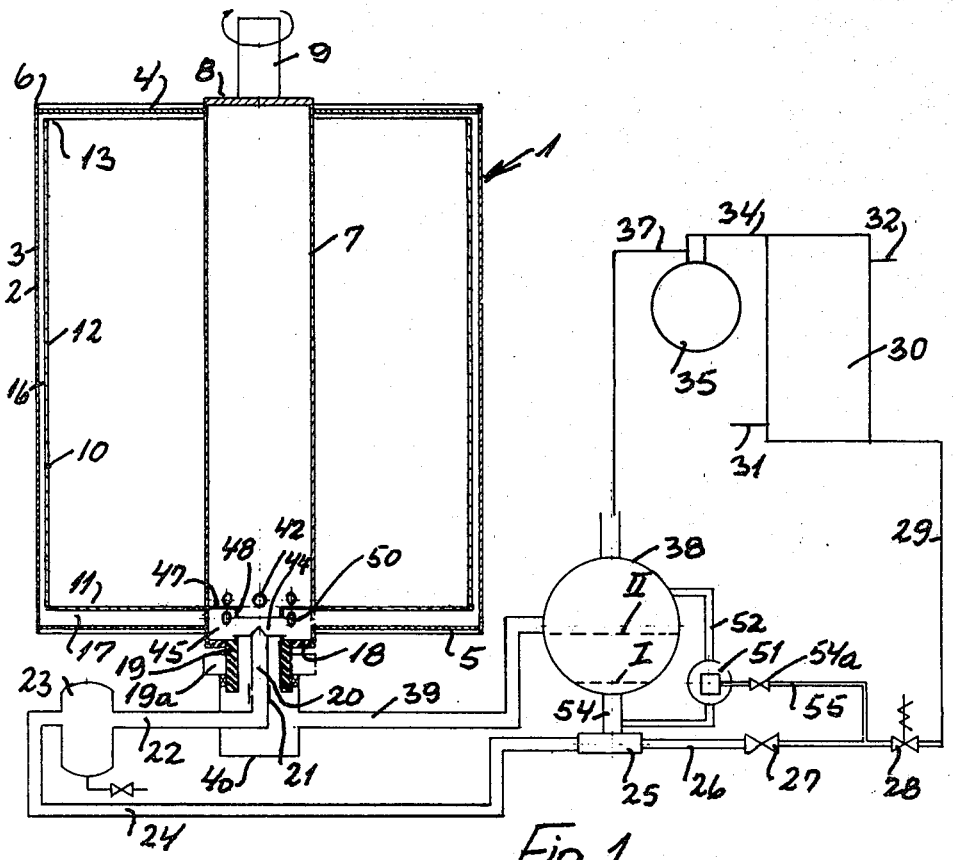
FIG. 1 schematically and partly in section shows a first embodiment of the plant according to the invention.

An apparatus which is to be cooled is generally designated 1 in the drawing. According to the embodiment illustrated the apparatus 1 comprises an apparatus for freezing a liquid as e.g. water, blood, cream or the like liquid medium. The apparatus comprises a cylindrical container 2 having a cylindrical wall 3 to which an upper and a lower end bottom 4 and 5 respectively is welded. The wall 3 extends a small distance beyond the upper end bottom 4 so that an edge 6 serving as a weir is formed which serves to distribute liquid which is fed on to the upper surface of the end bottom 4 in such a way that such liquid will flow downwardly along the outer surface of the wall 3. The apparatus is shown rather schematically on the drawing in that only the parts necessary for understanding the present invention have been shown. However, it should be added that the apparatus, furthermore, comprises a knife shaped scraper or rotor arranged outwardly of the wall 3 and which serves to peel off or burst off material which may have frozen on the outer surface of the cylindrical wall 3.

A vertical tube 7 is arranged between the end bottoms 4 and 5 and is welded thereto. The tube 7 is closed at the top end by means of an end bottom 8 to which a trunnion 9 is secured by means of which the top end of the apparatus may be arranged in a bearing, not shown. Accordingly, the container 2 may be rotated and may be moved past the aforementioned knife or rotor.

The tube 7 supports a cup shaped container generally designated 10 and comprising a bottom 11 having a central hole to the circumference of which the tube 7 is welded. Moreover, the container 10 comprises a cylindrical wall 12 the top edge 13 of which serves as a weir. The lower edge of the cylindrical wall 12 is welded to the circumference of the bottom 11.

The container wall 12 is positioned comparatively closely adjacent the inner surface of the container wall 2 in such a way that a space 16 is formed between the two walls 12 and 2, and this space 16 serves as an evaporator chamber. The lower end of this chamber communicates with an annular chamber 17 which surrounds the lower end of the tube 7 and which is defined between the two bottoms 5 and 11.

The lower end of the tube 7 extends downwardly a small distance beyond the end bottom 5 and is closed by an end bottom 18 which supports a hollow trunnion 19 which is rotatably supported with respect to a stationary support 19*a*. Coaxially in the hollow trunnion 19 a feed conduit 20 is arranged for feeding liquid refrigerant, and the conduit 20 is by means of a stuffing box 21 connected with the upwardly directed end of a stationary angular feed conduit 22. The feed conduit 22 is connected with an oil separator 23 which via a feed conduit 24 is connected with a pump 25. In the FIG. 1 embodiment, the pump 25 comprises an injector. The injector 25 is fed by means of a conduit 26 containing a reduction valve 27 which is connected with a magnet valve 28. The magnet valve 28 is by means of a conduit 29 connected with a condenser 30 which in the embodiment illustrated is cooled by means of a coolant e.g. water which is fed to the condenser via a pipe stub 31 and which is removed via a pipe stub 32. The condenser 30 is by means of a conduit 34 connected with a compressor 35 for refrigerant and the suction side of the compressor is by means of a conduit 37 connected to a vessel 38 which in the embodiment illustrated serves as a liquid/vapour separator. The separator is by means of a suction conduit 39 connected with a housing 40 in which feed conduit 22 is sealingly disposed. The housing 40 communicates with the interior of the tube 7 via the space between the hollow trunnion 19 and the conduit 20, and the interior of the tube 7 communicates with the interior of the container 10 via holes 42 provided in the lower end of the tube 7 but above the bottom 11 of the cup shaped container 10. The conduit 20 is connected with a transversely extending conduit 44, the ends of which open into an annular distribution chamber 45 which is defined in the lower end of the tube 7 by means of an annular plate 47 and a cylindrical inner wall 48. The distribution chamber 45 communicates with the spacing 17 between the end bottoms 5 and 11 via holes 50 in the tube 7.

The liquid/vapour separator 38 is provided with a level control valve 51 which by means of a conduit 52 is connected with the upper part of the separator 38 and which by means of a conduit 53 is connected with a connection part 54 which extends between the lower part of the separator 38 and the injector 25. Upstream with respect to the level control valve, a shut-off valve 54*a* is arranged and the latter is by means of a conduit 55 connected with the feed conduit of the injector 25 between the reduction valve 27 and the magnet valve 28.

Figure 2:
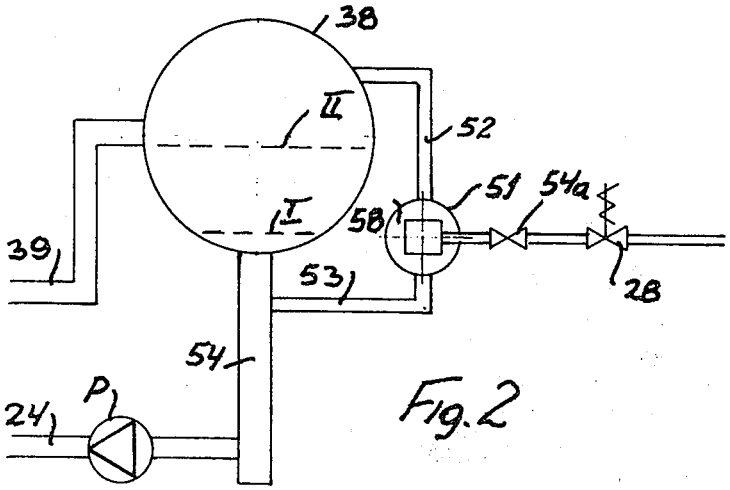
FIG. 2 shows, at an inlarged scale, a part of the plant shown in FIG. 1 for illustrating another embodiment of the plant according to the invention.

The level control valve 51 is constructed in the form of a float valve, the float 58 of which is indicated schematically in FIG. 2. The float controls in a known manner and accordingly not further illustrated the liquid level in the separator 38. The liquid level which prevails in the separator 38 during normal operation is indicated by a broken line I.

The plant illustrated in FIG. 1 operates in the following way:

Liquid refrigerant flows from the condenser 30 through the conduit 29 and the magnet valve 28, which is open during operation, to the reduction valve 27 which creates a predetermined pressure of the liquid refrigerant. In the injector 25 the flowing refrigerant serves as the active medium and, accordingly, suctions liquid refrigerant from the separator 38 via the connection part 54 and, accordingly, the refrigerant transferred from the injector 25 and to the feed conduit 24 achieves a pressure which is sufficiently high to overcome the static pressure difference which is caused by the level difference between the injector 25 and the weir 13 in the upper part of the container 2. Accordingly, the refrigerant is able to pass through the oil separator 23 via the heating conduit 24, through the conduit 22, through the transversely extending conduit 44, through the annular distribution chamber 45, through the holes 50 and into the interspace 17 and upwardly through the interspace between the two walls 12 and 13. It is assumed that all the parts of the plant, with the exception of the outer surface of the container 2 which is intended to serve as a cooling surface, are well insulated. Accordingly, evaporation will primarily be caused in the interspace 16 serving as an evaporator chamber, and a mixture of liquid and evaporated refrigerant will pass the weir 13. Via the holes 42, the mixture of evaporated refrigerant and liquid refrigerant flows through the suction conduit 39 to the liquid/vapour separator 38, and in the separator the liquid phase is separated whereas the gas formed phase via the suction conduit 37 is transferred to the compressor 35, whereinafter the circuit continues. During the operation the level control 51 serves to maintain the level I in the separator 38. It will be understood that by controlling the reduction valve 27 the capacity of the plant may be adapted in such a way that an appropriate amount of liquid refrigerant is recirculated in order to achieve a good heat transfer from the product and to the evaporating refrigerant.

When the apparatus illustrated is used for freezing e.g. the materials previously referred to, periodic cleaning of the outer surface of the wall 3 will be necessary, and in order to clean such surface efficiently a hot detergent must be used. Due to the fact that the conduits 22 and 39 for feeding liquid refrigerant and for suctioning refrigerant vapours respectively are connected with the lower end of the apparatus which is, accordingly, closed upwardly, and since the conduits referred to are connected with the vessel 38, liquid refrigerant which may be positioned in the apparatus when the cooling process is stopped may flow back to the separator 38. The liquid refrigerant which is positioned in the evaporator chamber 16 and in the annular interspace between the bottoms 5 and 11 will via the holes 50, the distributing chamber 45, the transversely extending conduit 44, the feeding conduit 20, the stuffing box 21, the oil separator 23, the feeding conduit 24 and the side inlet 54 of the injector 25 flow into the vessel 38. The liquid refrigerant which may be positioned within the cup shaped container will flow to the vessel 38 via the holes 42 in the tube 7, the interspace between the feeding conduit 21, and the inner surface of the hollow trunnion 19, and the suction conduit 39. The vessel 38 has dimensions such that it is capable of accommodating the maximum amount of refrigerant which may be positioned in the apparatus 1 at the time when a cleaning of the apparatus 1 is required and when such amount of liquid refrigerant has been transferred to the vessel 38, the liquid refrigerant contained in the vessel 38 will form a level as indicated by II. According to the embodiment illustrated in FIG. 1, the vessel 38 is arranged at such a height with respect to the apparatus 1 that the level II will be positioned below the end bottom 5 of the cylindrical container 2. Thus, only a very small evaporation will occur in the apparatus 1 before the apparatus is completely emptied of liquid refrigerant, and the following heating which is caused by the washing operation will, accordingly, only result in a superheating of refrigerant vapours in the apparatus 1 whereby the pressure will rise rather moderately in the apparatus 1 compared with the case where liquid refrigerant is present in the apparatus 1 during the whole cleaning operation. In the latter case the pressure rise in the apparatus 1 would correspond to the vapour pressure curve for saturated vapour of the refrigerant in question.

FIG. 2 shows another embodiment wherein a pump P is used instead of the injector 25 shown in FIG. 1. The pump P comprises e.g. by a centrifugal or another kind of flow pump which, accordingly, allows to be traversed in the direction opposite to the normal feeding direction of the pump. Otherwise the embodiment shown in FIG. 2 operates in the same way as described in connection with FIG. 1 except that the feeding of liquid refrigerant to the apparatus 1 takes place solely via the flow valve 51.

I claim:

1. A freezing plant comprising an apparatus 1 including an evaporator chamber 16, a compressor 35, a condensor 30 and a liquid/vapor separator 38, a suction conduit 37 interconnecting the top end of said separator 38 with said compressor 35, the lower end of said separator 38 being connected with the lower end of said apparatus and communicating with the lower end of said evaporator chamber 16 via a pump 25;P and feed conduit means 24, 22, 20, 44, 45, 50 and 17, said pump comprising a fluid pump so as to allow being traversed in the direction opposite to the normal feeding direction when not in operation, said pump 25:P and said feed conduit means 24, 22, 20, 44, 45, 50 and 17 being arranged so as to feed liquid refrigerant from said separator 38 to the lower end of said evaporator chamber 16 and to empty said evaporator chamber 16 of liquid refrigerant; said separator 38 being between its top and bottom ends connected to said apparatus 1 via suction conduit means 39, 42 connected to the lower end of said apparatus 1 and communicating with the top end of said evaporator chamber 16 so as to cause evaporation of said liquid refrigerant in said evaporator chamber 16 and to allow emptying of said apparatus of liquid refrigerant, said separator 38 being positioned generally at the same level as the lower end of said evaporator chamber 16 and having dimensions such that it is capable of accommodating the maximum amount of refrigerant contained in said evaporator chamber 16 and said apparatus 1.

2. Freezing plant according to claim 1, wherein said apparatus 1 comprises an outer cylindrical vertical wall 3 which is closed by upper and lower end bottoms 4, 5, a hollow trunnion 19 being secured to said lower end bottom 5 and being supported by stationary support means 19*a* so as to allow rotation of said apparatus about the vertical axis of said outer cylindrical wall 3; a cup shaped container 10 being arranged within said apparatus, said cup shaped container having a cylindrical wall 12 extending coaxially with respect to and inside said outer cylindrical wall 3 so as to define said evaporator chamber 16 therebetween, said inner cylindrical wall 12 extending slightly below said upper end bottom 4 so as to define an upper opening between the upper edge 13 of said inner cylindrical wall 12 and said upper end bottom 4, said upper opening connecting said evaporator chamber 16 and the interior of said cup shaped container 10, said cup shaped container 10 having a bottom 11 arranged above said lower end bottom 5 so as to define and annular interspace 17 between the bottom 11 of said cup shaped container 10 and said lower end bottom 5, the periphery of said interspace 17 communicating with the lower end of said evaporator chamber 16 and said interspace 17 communicating at the center of said interspace with a distributing chamber 45, said distributing chamber 45 being connected with said separator 38 by means of a feed conduit 20 comprising a portion of said feed conduit means and extending coaxially through said hollow trunnion 19, said hollow trunnion 19 being in communication with the interior of said cup shaped container 10 at the bottom 11 of said cup shaped container 10 and being connected to said separator 38 by means of a suction conduit 39 comprising a portion of said suction conduit means.

* * * * *